US011149732B2

(12) United States Patent
Akei

(10) Patent No.: US 11,149,732 B2
(45) Date of Patent: Oct. 19, 2021

(54) OPPOSED SCREW COMPRESSOR HAVING NON-INTERFERENCE SYSTEM

(71) Applicant: Carrier Corporation, Palm Beach Gardens, FL (US)

(72) Inventor: Masao Akei, Cicero, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 215 days.

(21) Appl. No.: 16/173,887

(22) Filed: Oct. 29, 2018

(65) Prior Publication Data

US 2019/0128260 A1 May 2, 2019

Related U.S. Application Data

(60) Provisional application No. 62/580,744, filed on Nov. 2, 2017.

(51) Int. Cl.
*F04C 18/08* (2006.01)
*F04C 18/16* (2006.01)

(52) U.S. Cl.
CPC ..... *F04C 18/088* (2013.01); *F04C 18/16* (2013.01)

(58) Field of Classification Search
CPC .. F01C 11/00; F01C 1/165; F01C 1/16; F04C 23/005; F04C 23/008; F04C 2270/56; F04C 18/16; F04C 2250/301; F04C 2250/20; F04C 2250/30; F04C 2/107
See application file for complete search history.

(56) References Cited

U.S. PATENT DOCUMENTS 1,430,894 A 10/1922 Fay
1,701,166 A 2/1929 Tifft
2,659,239 A * 11/1953 Nilsson ..... F01C 21/008 74/395
2,714,857 A 8/1955 Albright et al.
2,804,260 A 8/1957 Hilsson et al.
2,975,963 A 3/1961 Nilsson
3,467,300 A 9/1969 Schibbye
3,589,843 A 6/1971 Zalis
4,776,779 A * 10/1988 Crump ..... F01C 1/165 417/197
4,820,135 A 4/1989 Simmons
4,828,036 A 5/1989 Simmons
(Continued)

FOREIGN PATENT DOCUMENTS

CH 322415 A 6/1957
CN 102220974 A 10/2011
(Continued)

OTHER PUBLICATIONS

DE2550360 translation (Year: 2020).*
(Continued)

*Primary Examiner* — Devon C Kramer
*Assistant Examiner* — David N Brandt
(74) *Attorney, Agent, or Firm* — Cantor Colburn LLP

(57) ABSTRACT

A fluid machine includes a first rotor rotatable about a first axis. The first rotor has a first portion and a second portion. A second rotor is rotatable about a second axis. The second rotor includes a first portion and a second portion. At least one spacer is associated with the first rotor and the second rotor to limit intermeshing engagement between the first rotor and the second rotor.

16 Claims, 6 Drawing Sheets

(56) References Cited

U.S. PATENT DOCUMENTS

| | | | | |
|---|---|---|---|---|
| 6,093,008 | A * | 7/2000 | Kirsten | F04C 18/16 418/200 |
| 7,074,026 | B2 * | 7/2006 | Graber, Jr. | F04C 18/084 418/201.1 |
| 8,864,486 | B2 * | 10/2014 | Dispenza | B29C 48/38 425/208 |
| 8,985,975 | B2 | 3/2015 | Denny | |
| 8,992,195 | B2 | 3/2015 | Hossain et al. | |
| 9,453,396 | B2 | 9/2016 | Davis | |
| 2011/0158841 | A1 * | 6/2011 | Liu | F04C 11/001 418/202 |

FOREIGN PATENT DOCUMENTS

| | | | | |
|---|---|---|---|---|
| CN | 104005950 | A | 8/2014 | |
| DE | 2550360 | A1 * | 5/1977 | F01C 11/00 |
| DE | 102013010886 | A1 | 1/2014 | |

OTHER PUBLICATIONS

Extended European Search Report; International Application No. 18203802.6-1004; International Filing Date: Oct. 31, 2018; dated Jul. 19, 2019; 8 pages.

* cited by examiner

OPPOSED SCREW COMPRESSOR HAVING NON-INTERFERENCE SYSTEM

CROSS-REFERENCE TO RELATED APPLICATIONS

This application claims the benefit of U.S. Provisional Application Ser. No. 62/580,744, filed Nov. 2, 2017, which is incorporated herein by reference in its entirety.

BACKGROUND

The subject matter disclosed herein relates generally to fluid machines, and more specifically, to fluid machines, such as compressors, having helically lobed rotors.

It has been determined that commonly used refrigerants, such as R-410A in one non-limiting example, have unacceptable global warming potential (GWP) such that their use will cease for many HVAC&R applications. Non-flammable, low GWP refrigerants are replacing existing refrigerants in many applications, but have lower density and do not possess the same cooling capacity as existing refrigerants. Replacement refrigerants require a compressor capable of providing a significantly greater displacement, such as a screw compressor.

Existing screw compressors typically utilize roller, ball, or other rolling element bearings to precisely position the rotors and minimize friction during high speed operation. However, for typical HVAC&R applications, existing screw compressors with roller element bearings result in an unacceptably large and costly fluid machine.

Therefore, there exists a need in the art for an appropriately sized and cost effective fluid machine that minimizes friction while allowing precise positioning and alignment of the rotors.

BRIEF DESCRIPTION

According to one aspect, a fluid machine includes a first rotor rotatable about a first axis. The first rotor has a first portion and a second portion. A second rotor is rotatable about a second axis. The second rotor includes a first portion and a second portion. At least one spacer is associated with the first rotor and the second rotor to limit intermeshing engagement between the first rotor and the second rotor.

In addition to one or more of the features described above, or as an alternative, in further embodiments the at least one spacer is positioned between the first portion and the second portion of at least one of the first rotor and the second rotor to prevent the first portion of the second rotor from engaging the second portion of the first rotor.

In addition to one or more of the features described above, or as an alternative, in further embodiments the at least one spacer is positioned between the first portion and second portion of the second rotor to prevent the first portion of the second rotor from engaging the second portion of the first rotor.

In addition to one or more of the features described above, or as an alternative, in further embodiments the at least one spacer is positioned between the first portion and second portion of the first rotor to prevent the first portion of the first rotor from engaging the second portion of the second rotor.

In addition to one or more of the features described above, or as an alternative, in further embodiments including a casing, a first shaft for supporting the first rotor relative to the casing, and a second shaft for supporting the second rotor relative to the casing. The at least one spacer is mounted concentrically with at least one of the first shaft and the second shaft.

In addition to one or more of the features described above, or as an alternative, in further embodiments the first portion of the first rotor has a first upper rotor length M1, the second portion of the first rotor has a first lower rotor length M2, the first portion of the second rotor has a second upper rotor length F1, the second portion of the second rotor has a second lower rotor length F2, a first upper rotor axial clearance C1 is formed between the first portion of the first rotor and the casing, a first lower rotor axial clearance C2 is formed between the second portion of the first rotor and the casing, a second upper rotor axial clearance D1 is formed between the first portion of the second rotor and the casing, and a second lower rotor axial clearance D2 is formed between the second portion of the second rotor and the casing.

In addition to one or more of the features described above, or as an alternative, in further embodiments the at least one spacer has an axial thickness such that the first upper rotor axial clearance C1 is equal to the second upper rotor axial clearance D1 and the first lower rotor axial clearance C2 is equal to the second lower rotor axial clearance D2.

In addition to one or more of the features described above, or as an alternative, in further embodiments an axial thickness of the at least one spacer is selected based on an arrangement of the first rotor and second rotor.

In addition to one or more of the features described above, or as an alternative, in further embodiments the at least one spacer is positioned between the first portion and the second portion of the first rotor, and an axial thickness of the spacer is greater than a summation of the second upper rotor length F1, the second upper rotor axial clearance D1 and the second lower rotor axial clearance D2 minus the first upper rotor length M1.

In addition to one or more of the features described above, or as an alternative, in further embodiments the at least one spacer is positioned between the first portion and the second portion of the first rotor, and an axial thickness of the spacer is greater than a summation of the second lower rotor length F2, the second upper rotor axial clearance D1 and the second lower rotor axial clearance D2 minus the first lower rotor length M2.

In addition to one or more of the features described above, or as an alternative, in further embodiments the at least one spacer is positioned between the first portion and the second portion of the second rotor, and an axial thickness of the spacer is greater than a summation of the first lower rotor length M2, the first upper rotor axial clearance C1 and the first lower rotor axial clearance C2 minus the second lower rotor length F2.

In addition to one or more of the features described above, or as an alternative, in further embodiments the at least one spacer is positioned between the first portion and the second portion of the second rotor, and an axial thickness of the spacer is greater than a summation of the first upper rotor length M1, the first upper rotor axial clearance C1 and the first lower rotor axial clearance C2 minus the second upper rotor length F1.

According to another aspect, a fluid machine includes a first rotor rotatable about a first axis, a second rotor rotatable about a second axis, at least one spacer associated with the first rotor and the second rotor to limit intermeshing engagement between the first rotor and the second rotor, a motor for driving rotation of at least one of the first rotor and the second rotor, and a casing for rotatably supporting at least one of the first rotor and the second rotor.

In addition to one or more of the features described above, or as an alternative, in further embodiments the at least one spacer is mounted concentrically with at least one of the first shaft and the second shaft.

In addition to one or more of the features described above, or as an alternative, in further embodiments the first rotor includes a first portion and a second portion and the second rotor includes a first portion and a second portion.

In addition to one or more of the features described above, or as an alternative, in further embodiments the at least one spacer is positioned between the first portion and second portion of the second rotor to prevent the first portion of the second rotor from engaging the second portion of the first rotor.

In addition to one or more of the features described above, or as an alternative, in further embodiments the at least one spacer is positioned between the first portion and second portion of the first rotor to prevent the first portion of the first rotor from engaging the second portion of the second rotor.

In addition to one or more of the features described above, or as an alternative, in further embodiments the at least one spacer includes a first spacer positioned between the first portion and second portion of the first rotor and a second spacer positioned between the first portion and second portion of the second rotor, the first spacer having a first thickness and the second spacer having a second thickness different from the first thickness.

In addition to one or more of the features described above, or as an alternative, in further embodiments a clearance between the first rotor and the casing is equal to a clearance between the second rotor and the casing.

BRIEF DESCRIPTION OF THE DRAWINGS

The subject matter, which is regarded as the disclosure, is particularly pointed out and distinctly claimed in the claims at the conclusion of the specification. The foregoing and other features, and advantages of the disclosure are apparent from the following detailed description taken in conjunction with the accompanying drawings in which:

The detailed description explains embodiments of the disclosure, together with advantages and features, by way of example with reference to the drawings.

DETAILED DESCRIPTION

Figure 1:
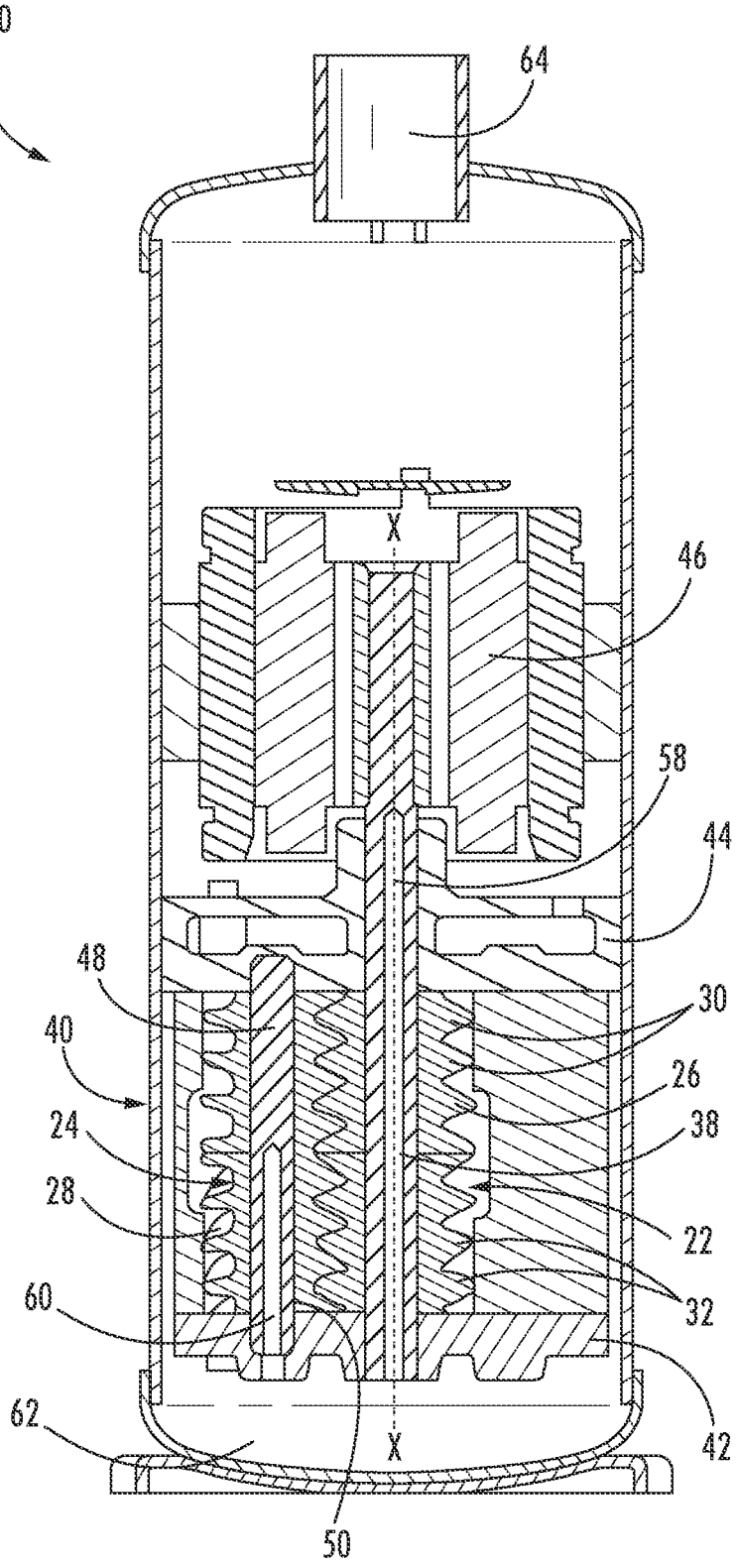
FIG. 1 is cross-sectional view of a fluid machine according to an embodiment.
Figure 2:
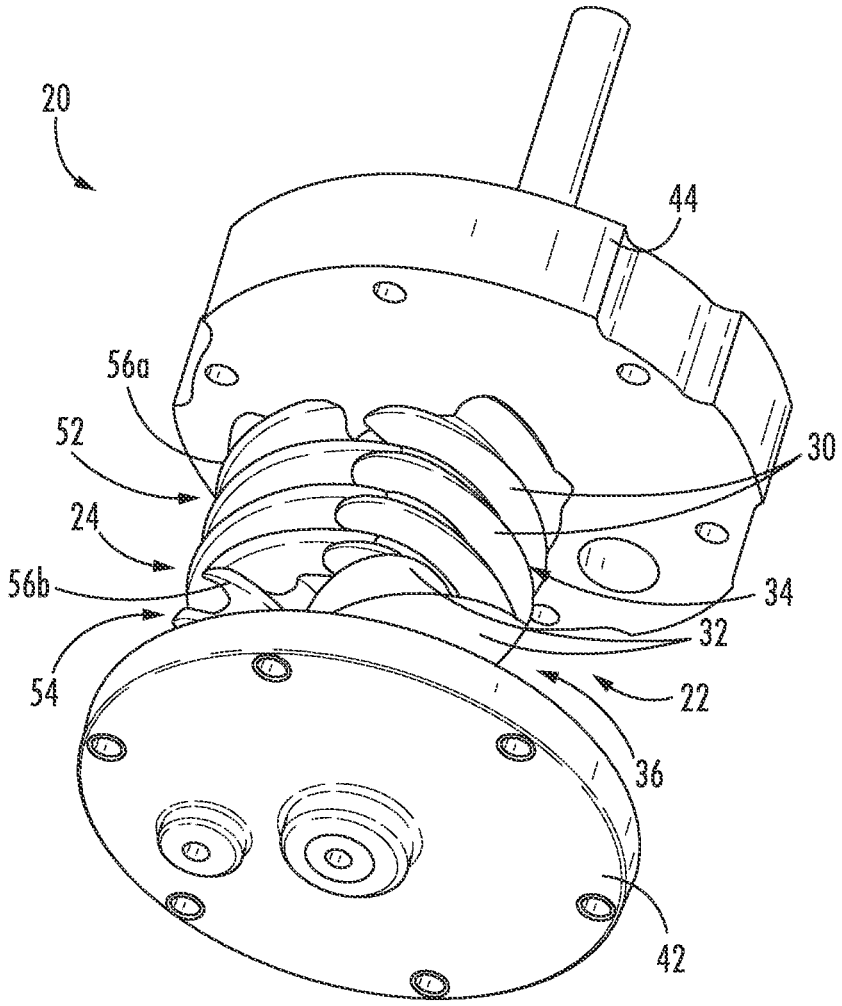
FIG. 2 is a perspective view of a fluid machine according to an embodiment.
Figure 3:
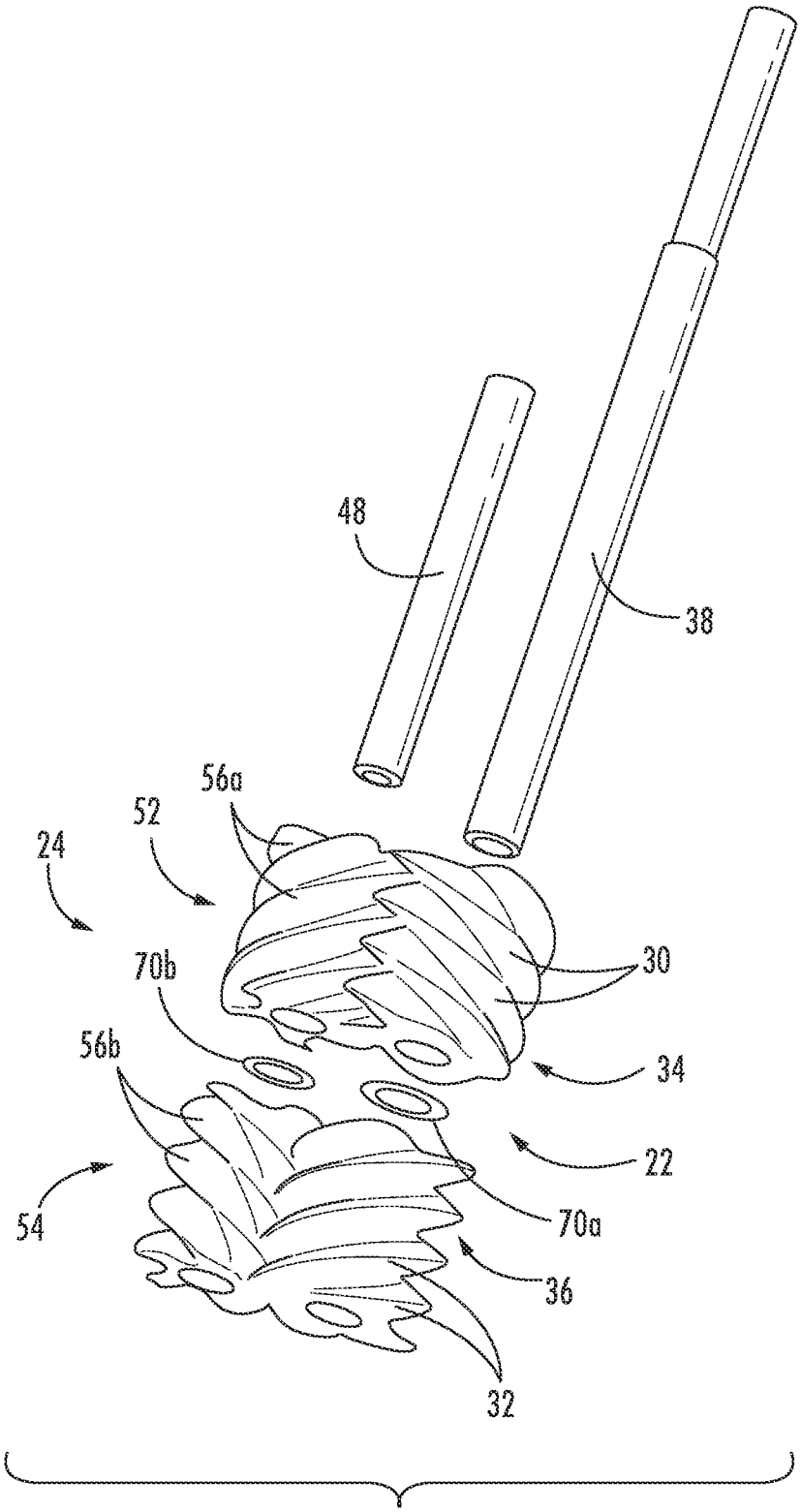
FIG. 3 is an exploded view of the first rotor and the second rotor according to an embodiment.

Referring now to the FIGS. 1 and 2, a fluid machine 20 is illustrated. In the illustrated, non-limiting embodiment, the fluid machine 20 is an opposed screw compressor. However, other suitable embodiments of a fluid machine, such as a pump, fluid motor, or engine for example, are also within the scope of the disclosure. The fluid machine 20 includes a first rotor 22 intermeshed with a second rotor 24. In an embodiment, the first rotor 22 is a male rotor having a male-lobed working portion 26 and the second rotor 24 is a female rotor including a female-lobed portion 28. Alternatively, the first rotor 22 may be a female rotor and the second rotor 24 may be a male rotor. The working portion 26 of the first rotor 22 includes at least one first helical lobe 30 and at least one second helical lobe 32. In the illustrated, non-limiting embodiment, the first rotor 22 includes two separate portions 34, 36 defining the first helical lobes 30 and the second helical lobes 32, respectively.

The fluid machine 20 includes a first shaft 38 fixed for rotation with the first rotor 22. The fluid machine 20 further include a casing 40 rotatably supporting the first shaft 38 and at least partially enclosing the first rotor 22 and the second rotor 24. A first end 42 and a second end 44 of the casing 40 are configured to rotatably support the first shaft 38. The first shaft 38 of the illustrated embodiments is directly coupled to an electric motor 46 operable to drive rotation of the first shaft 38 about an axis X. Any suitable type of electric motor 46 is contemplated herein, including but not limited to an induction motor, permanent magnet (PM) motor, and switch reluctance motor for example. In an embodiment, the first rotor 22 is fixed to the first shaft 38 by a fastener, coupling, integral formation, interference fit, and/or any additional structures or methods known to a person having ordinary skill in the art (not shown), such that the first rotor 22 and the first shaft 38 rotate about axis X in unison.

The fluid machine 20 additionally includes a second shaft 48 operable to rotationally support the second rotor 24. The second rotor 24 includes an axially extending bore 50 within which the second shaft 48 is received. In an embodiment, the second shaft 48 is stationary or fixed relative to the casing 40 and the second rotor 24 is configured to rotate about the second shaft 48. However, embodiments where the second shaft 48 is also rotatable relative to the casing 40 are also contemplated herein.

With specific reference to FIG. 2, the first rotor 22 is shown as including a first portion 34 having four first helical lobes 30 and a second portion 36 having four second helical lobes 32. The illustrated, non-limiting embodiment, is intended as an example only, and it should be understood by a person of ordinary skill in the art that any suitable number of first helical lobes 30 and second helical lobes 32 are within the scope of the disclosure. As shown, the first helical lobes 30 and the second helical lobes 32 have opposite helical configurations. In the illustrated, non-limited embodiment, the first helical lobes 30 are left-handed and the second helical lobes 32 are right-handed. Alternatively, the first helical lobes 30 may be right-handed and the second helical lobes 32 may be left-handed.

By including lobes 30, 32 with having opposite helical configurations, opposing axial flows are created between the first and second helical lobes 30, 32. Due to the symmetry of the axial flows, thrust forces resulting from the helical lobes 30, 32 are generally equal and opposite, such that the thrust forces substantially cancel one another. As a result, this configuration of the opposing helical lobes 30, 32 provides a design advantage since the need for thrust bearings in the fluid machine can be reduced or eliminated.

The second rotor 24 has a first portion 52 configured to mesh with the first helical lobes 30 and a second portion 54 configured to mesh with the second helical lobes 32. To achieve proper intermeshing engagement between the first rotor 22 and the second rotor 24, each portion 52, 54 of the second rotor 24 includes one or more lobes 56 having an opposite configuration to the corresponding helical lobes 30, 32 of the first rotor 22. In the illustrated, non-limiting embodiment, the first portion 52 of the second rotor 24 has at least one right-handed lobe 56*a*, and the second portion 54 of the second rotor 24 includes at least one left-handed lobe 56*b*.

In an embodiment, the first portion 52 of the second rotor 24 is configured to rotate independently from the second portion 54 of the second rotor 24. However, embodiments where the first and second portions 52, 54 are rotationally coupled are also contemplated herein. Each portion 52, 54 of the second rotor 24 may include any number of lobes 56. In an embodiment, the total number of lobes 56 formed in each portion 52, 54 of the second rotor 24 is generally larger than a corresponding portion, 34 and 36, respectively, of the first rotor 22. For example, if the first rotor 22 includes four first helical lobes 30, the first portion 54 of the second rotor 24 configured to intermesh with the first helical lobes 30 may include five helical lobes 56*a*. However, embodiments where the total number of lobes 56 in a portion 52, 54 of the second rotor 24 is equal to a corresponding group of helical lobes (i.e. the first helical lobes 30 or the second helical lobes 32) of the first rotor 22 are also within the scope of the disclosure.

Returning to FIG. 1, the fluid machine 20 may include a first shaft passage 58 extending axially through the first shaft 38 and a second shaft passage 60 extending axially through a portion of the second shaft 48. The first shaft passage 58 and/or the second shaft passage 60 communicate lubricant from a sump 62, through first shaft 38 and/or second shaft 48, out one or more radial passages (not shown), and along one or more surfaces of the first rotor 22 and/or the second rotor 24. The fluid machine 20 further includes an axially-extending passage (not shown) defined between the second shaft 48 and the bore 50 formed in the second rotor 24. The passage is configured to allow lubricant to pass or circulate there through. In an embodiment, relatively high pressure discharge at first and second ends 42, 44 of the casing 40, the first rotor 22, and the second rotor 24 and relatively low pressure suction at a central location of the first rotor 22 and the second rotor 24 urge lubricant through each of the passages. The circulation of lubricant through the passage disposed between bore 50 and the second shaft 48 provides internal bearing surfaces between each of the first and second portions 52, 54 and the second shaft 48 to reduce friction there between and further allow the first portion 52 of the second rotor 24 to rotate independently of the second portion 54 of the second rotor 24.

During operation of the fluid machine 20 of one embodiment, a gas or other fluid, such as a low GWP refrigerant for example, is drawn to a central location by a suction process generated by the fluid machine 20. Rotation of the first rotor 22 and the second rotor 24 compresses the refrigerant and forces the refrigerant toward first and second ends 42, 44 of the casing 40 between the sealed surfaces of the meshed rotors 22, 24 due to the structure and function of the opposing helical rotors 22, 24. The compressed refrigerant is routed by an internal gas passage within the casing 40 and discharged through the second end 44 of the casing 40. The discharged refrigerant passes through the electric motor 46 and out of a discharge passage 64.

With reference now to FIGS. 3-6, the first rotor 22 and the second rotor 24 are illustrated in more detail. To avoid interference between the lobes 56*a* of the first portion 52 of the second rotor 24 and the lobes 32 of the second portion 36 of the first rotor 22, or alternatively, interference between the lobes 56*b* of the second portion 52 of the second rotor 24 and the lobes 30 of the first portion 34 of the first rotor 22, at least one of the first and second rotors 22, 24 includes a spacer or shim 70. As shown in the FIGS., in an embodiment, a first spacer 70*a* is located between the first, upper portion 34 and the second, lower portion 36 of the first rotor 22 and a second spacer 70*b* is located between the first, upper portion 52 and the second, lower portion 54 of the second rotor 24. However, embodiments where only one of the first and second rotor 22, 24 includes a spacer 70 are also contemplated herein.

The one or more spacers may be formed from any suitable material, including but not limited to a plastic or metal for example. In an embodiment, the spacer 70 is generally circular in shape and has a centrally located opening extending there through. An inner diameter of the opening is greater than the diameter of a corresponding shaft 38, 48 associated with the rotor 22, 24 such that the shaft 38, 48 may be received therein to mount the spacer concentrically with the shaft 38, 48. Further, an outer diameter of the spacer 70 is larger than the inner diameter of the bore, such as bore 50 for example, formed in the rotor 22, 24 to retain the spacer 70 at a position between the ends of adjacent rotor portions.

Figure 4:
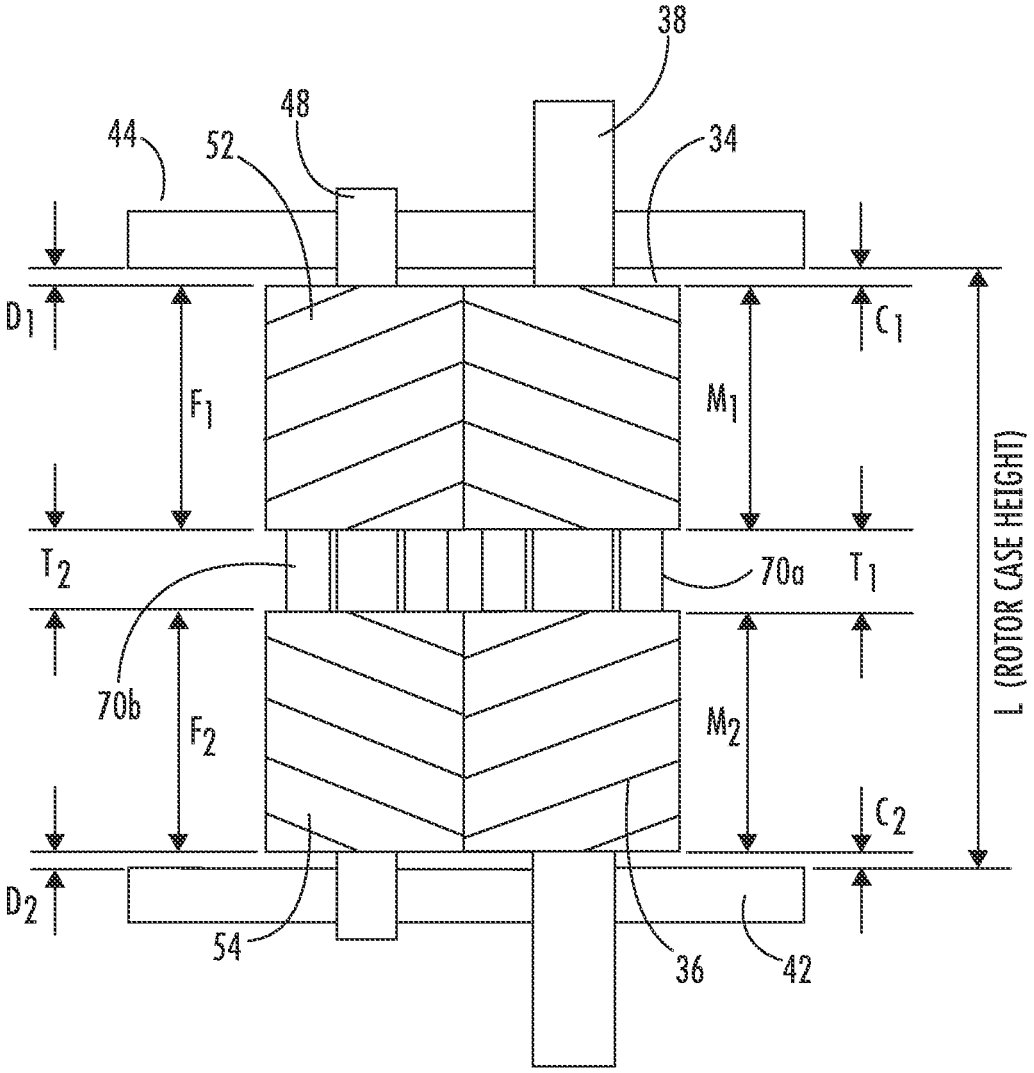
FIG. 4 is a cross-sectional view of the first rotor and the second rotor according to an embodiment.
Figure 5:
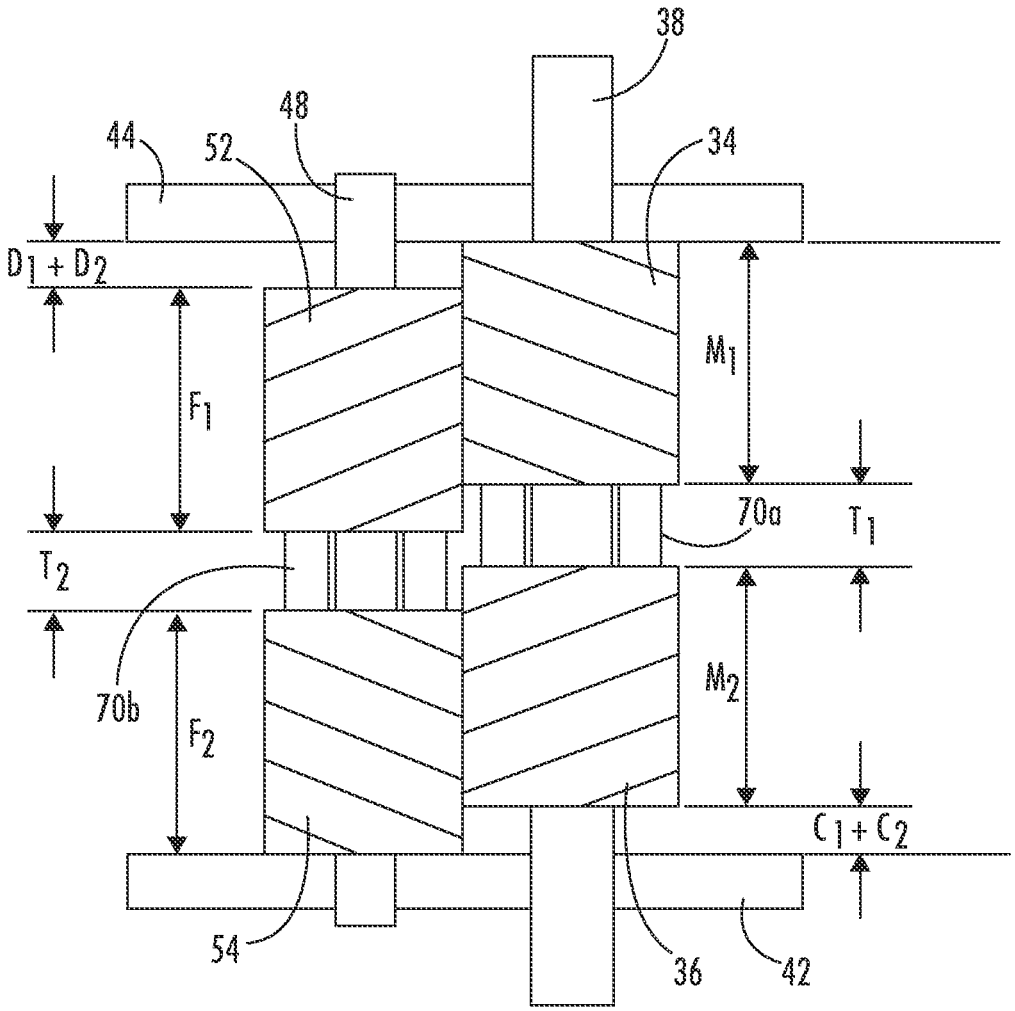
FIG. 5 is a cross-sectional view of the first rotor and the second rotor in a first scenario according to an embodiment.

With reference to FIG. 4, the first portion 34 of the first rotor 22 has a first upper rotor length M1, and the second portion 36 of the first rotor 22 has a first lower rotor length M2. Similarly, the first portion 52 of the second rotor 24 has a second upper rotor length F1, and the second portion 54 of the second rotor 24 has a second lower rotor length F2. A first upper rotor axial clearance C1 is defined between the first portion 34 of the first rotor 22 and an adjacent surface of the rotor case 40, and a first lower rotor axial clearance C2 is defined between the second portion 36 of the first rotor 22 and an adjacent surface of the rotor case 40. Similarly, a second upper rotor axial clearance D1 is defined between the first portion 52 of the second rotor 24 and an adjacent surface of the rotor case 40, and a second lower rotor axial clearance D2 is defined between the second portion 54 of the second rotor 24 and an adjacent surface of the rotor case 40.

The thickness of the at least one spacer 70 should be selected to avoid interference between lobes 56*a* and 32, and between lobes 56*b* and 30 during operation of the machine 20 in various worst case scenarios. In a first scenario, illustrated in FIG. 5, the first portion 34 of the first rotor 22 is arranged in contact with the surface of the rotor casing 40 and the second portion 54 of the second rotor 24 is arranged in contact with surface of the rotor casing. In such embodiments, the sum of the first upper rotor length M1 and the thickness T1 of the spacer 70*a* positioned between the first and second portions 34, 36 of the first rotor 22 must be greater than the sum of the second upper rotor length F1, the second upper rotor axial clearance D1, and the second lower rotor axial clearance D2. Expressed differently, the thickness T1 of the spacer 70*a* is greater than the summation of the second upper rotor length F1, the second upper rotor axial clearance D1 and the second lower rotor axial clearance D2 minus the first upper rotor length M1.

In this first scenario, the sum of the second lower rotor length F2 and the thickness T2 of the spacer 70*b* positioned between the first and second portions 52, 54 of the second rotor 24 must be greater than the sum of the first lower rotor length F2, the first upper rotor axial clearance C1, and the first lower rotor axial clearance C2. Expressed differently, the thickness T2 of the spacer 70*b* is greater than the summation of the first lower rotor length M2, the first upper rotor axial clearance C1 and the first lower rotor axial clearance C2 minus the second lower rotor length F2.

Figure 6:
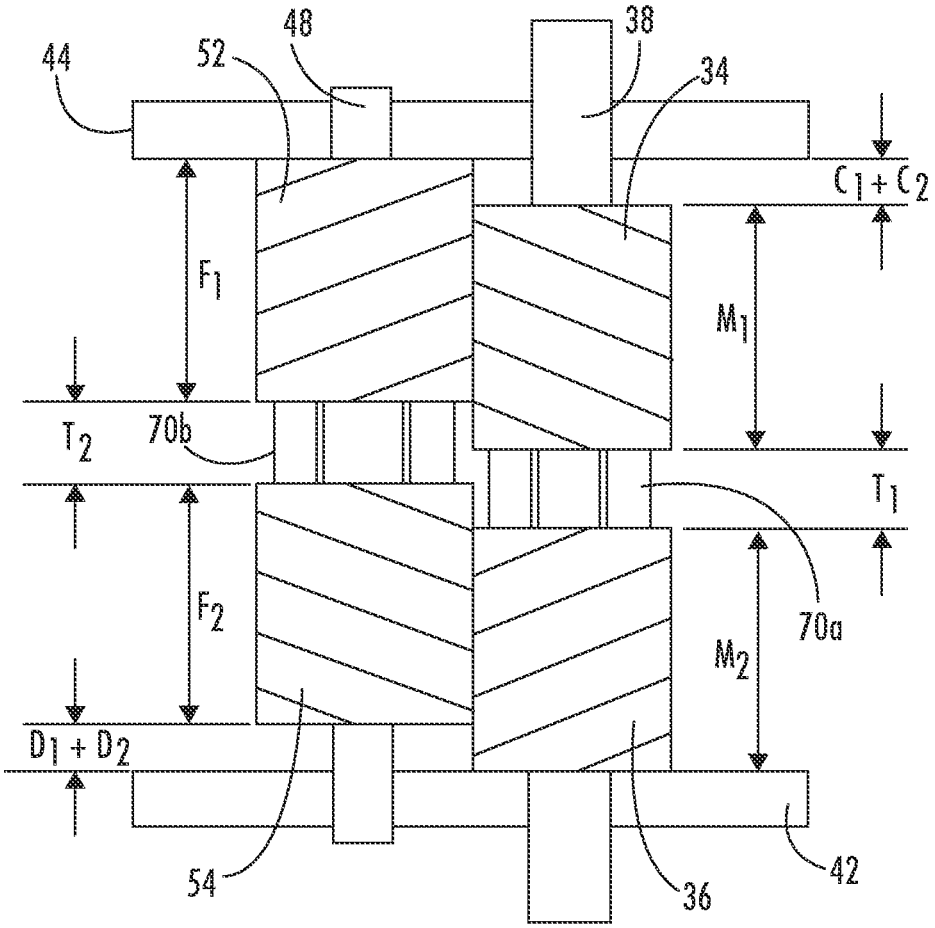
FIG. 6 is a cross-sectional view of the first rotor and the second rotor in a second scenario according to an embodiment.

In a second scenario, illustrated in FIG. 6, the second portion 36 of the first rotor 22 is arranged in contact with the surface of the rotor casing 40 and the first portion 52 of the second rotor 24 is arranged in contact with surface of the rotor casing. In such embodiments, the sum of the first lower rotor length M2 and the thickness T1 of the spacer 70*a* positioned between the first and second portions 34, 36 of the first rotor 22 must be greater than the sum of the second lower rotor length F2, the second upper rotor axial clearance D1, and the second lower rotor axial clearance D2. Expressed differently, the thickness T1 of the spacer 70*a* is greater than the summation of the second lower rotor length F2, the second upper rotor axial clearance D1 and the second lower rotor axial clearance D2 minus the first lower rotor length M2.

Similarly, in this second scenario, the sum of the second upper rotor length F1 and the thickness T2 of the spacer 70*b* positioned between the first and second portions 52, 54 of the second rotor 24 must be greater than the sum of the first upper rotor length M1, the first upper rotor axial clearance C1, and the first lower rotor axial clearance C2. Expressed differently, the thickness T2 of the spacer 70*b* is greater than the summation of the first upper rotor length M1, the first upper rotor axial clearance C1 and the first lower rotor axial clearance C2 minus the second upper rotor length F1. If the thickness of a spacer varies between the first scenario and the second scenario, the greater thickness should be selected.

In an embodiment, the thickness of the first spacer 70*a* and the thickness of the second spacer 70*b* may be selected such that the first upper rotor axial clearance C1 is equal to the second upper rotor axial clearance D1 and the first lower rotor axial clearance C2 is equal to the second lower rotor axial clearance D2. In such embodiments, the thickness of the first spacer 70*a* is equal to a total axial length L of the rotor case 40 minus the summation of the first upper rotor length M1, the first lower rotor length M1, the first upper rotor axial clearance C1 and the first lower rotor axial clearance C2. Similarly, the thickness of the second spacer 70*b* is equal to the total axial length L of the rotor case 40 minus the summation of the second upper rotor length F1, the second lower rotor length F1, the second upper rotor axial clearance D1 and the second lower rotor axial clearance D2.

Inclusion of one or more spacers 70 as described herein provides a more secure operation of the fluid machine 20 with minimal additional cost. Not only are the one or more spacers 70 operable to avoid unintentional interference between lobes, but also to control the axial clearance of the machine 20. Further, use of such spacers is most cost effective than restricting the manufacturing tolerances of the machine 20 to avoid such interference.

While the disclosure has been described in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments of the disclosure have been described, it is to be understood that aspects of the disclosure may include only some of the described embodiments. Accordingly, the disclosure is not to be seen as limited by the foregoing description, but is only limited by the scope of the appended claims.

What is claimed is:

1. A fluid machine comprising:

a first rotor rotatable about a first axis, the first rotor including a first portion and a second portion, wherein the first portion of the first rotor has a first plurality of lobes having a first configuration and the second portion of the first rotor has a second plurality of lobes having a second configuration distinct from the first configuration;

a second rotor rotatable about a second axis, the second rotor including a first portion and a second portion;

a first shaft for supporting the first rotor relative to a casing, wherein the first shaft defines the first axis;

a second shaft for supporting the second rotor relative to the casing, wherein the second shaft defines the second axis; and a spacer associated with the first rotor to limit intermeshing engagement between the first rotor and the second rotor, wherein the spacer is associated with the first shaft, the spacer being positioned to overlap a lobe of at least one of the first portion and the second portion of the second rotor relative to a direction parallel to the first axis.

2. The fluid machine of claim 1, where the spacer is positioned between the first portion and the second portion of the first rotor to prevent the first portion of the second rotor from engaging the second portion of the first rotor.

3. The fluid machine of claim 2, further comprising a second spacer associated with to the second shaft, the second spacer being configured to prevent the first portion of the first rotor from engaging the second portion of the second rotor.

4. The fluid machine of claim 1, wherein the spacer is mounted concentrically with the first shaft.

5. The fluid machine of claim 1, wherein the first portion of the first rotor has a first upper rotor length M1, the second portion of the first rotor has a first lower rotor length M2, the first portion of the second rotor has a second upper rotor length F1, the second portion of the second rotor has a second lower rotor length F2, a first upper rotor axial clearance C1 between the first portion of the first rotor and the casing, a first lower rotor axial clearance C2 between the second portion of the first rotor and the casing, a second upper rotor axial clearance D1 between the first portion of the second rotor and the casing, and a second lower rotor axial clearance D2 between the second portion of the second rotor and the casing, wherein each of the first upper rotor length M1, the first lower rotor length M2, the second upper rotor length F1 and the second lower rotor length F2 is greater than zero.

6. The fluid machine of claim 5, wherein the spacer has an axial thickness such that the first upper rotor axial clearance C1 is equal to the second upper rotor axial clearance D1, and the first lower rotor axial clearance C2 is equal to the second lower rotor axial clearance D2.

7. The fluid machine of claim 5, wherein the spacer is positioned between the first portion and the second portion of the first rotor, and an axial thickness of the spacer measured parallel to one of the first axis and the second axis is greater than a summation of the second upper rotor length F1, the second upper rotor axial clearance D1 and the second lower rotor axial clearance D2 minus the first upper rotor length M1, wherein the axial thickness of the spacer is greater than zero.

8. The fluid machine of claim 5, wherein the spacer is positioned between the first portion and the second portion of the first rotor, and an axial thickness of the spacer measured parallel to one of the first axis and the second axis is greater than a summation of the second lower rotor length F2, the second upper rotor axial clearance D1 and the second lower rotor axial clearance D2 minus the first lower rotor length M2, wherein the axial thickness of the spacer is greater than zero.

9. The fluid machine of claim 5, further comprising another spacer associated with the second shaft, wherein the another spacer is positioned between the first portion and the second portion of the second rotor, and an axial thickness of the another spacer measured parallel to one of the first axis and the second axis is greater than a summation of the first lower rotor length M2, the first upper rotor axial clearance C1 and the first lower rotor axial clearance C2 minus the second lower rotor length F2, wherein the axial thickness of the another spacer is greater than zero.

10. The fluid machine of claim 5, further comprising another spacer associated with the second shaft, wherein the another spacer is positioned between the first portion and the second portion of the second rotor, and an axial thickness of the another spacer measured parallel to one of the first axis and the second axis is greater than a summation of the first upper rotor length M1, the first upper rotor axial clearance C1 and the first lower rotor axial clearance C2 minus the second upper rotor length F1, wherein the axial thickness of the another spacer is greater than zero.

11. A fluid machine comprising:

a first rotor rotatable about a first axis, wherein the first rotor has a first portion including a first plurality of lobes having a first configuration and a second portion including a second plurality of lobes having a second configuration distinct from the first configuration;

a second rotor rotatable about a second axis, the second rotor having a plurality of second lobes;

at least one spacer associated with the first rotor and the second rotor to limit intermeshing engagement between the first rotor and the second rotor;

a motor for driving rotation of at least one of the first rotor and the second rotor; and a casing for rotatably supporting at least one of the first rotor and the second rotor; and a first shaft defining said first axis; the first portion of the first rotor, the at least one spacer, and the second portion of the first rotor being mounted to the first shaft, wherein a portion of the at least one spacer overlaps at least one of the plurality of second lobes of the second rotor relative to a direction parallel to the first axis.

12. The fluid machine of claim 11, wherein the first rotor is mounted to the first shaft and the second rotor is mounted to a second shaft, the at least one spacer being mounted concentrically with at least one of the first shaft and the second shaft.

13. The fluid machine of claim 11, wherein the second rotor includes a first portion and a second portion.

14. The fluid machine of claim 13, wherein the at least one spacer is positioned between the first portion and second portion of the first rotor to prevent the first portion of the first rotor from engaging the second portion of the second rotor.

15. The fluid machine of claim 13, wherein the at least one spacer includes a first spacer positioned between the first portion and second portion of the first rotor and a second spacer positioned between the first portion and second portion of the second rotor, the first spacer having a first thickness and the second spacer having a second thickness different from the first thickness.

16. The fluid machine of claim 13, wherein a clearance between the first rotor and the casing is equal to a clearance between the second rotor and the casing.

* * * * *